US007040862B2

(12) United States Patent
Otsuka

(10) Patent No.: US 7,040,862 B2
(45) Date of Patent: May 9, 2006

(54) AXIAL FLOW FAN

(75) Inventor: Shuichi Otsuka, Miyota-Machi (JP)

(73) Assignee: Minebea Co. Ltd., (JP)

( * ) Notice: Subject to any disclaimer, the term of this patent is extended or adjusted under 35 U.S.C. 154(b) by 33 days.

(21) Appl. No.: 10/683,769

(22) Filed: Oct. 10, 2003

(65) Prior Publication Data

US 2004/0141841 A1 Jul. 22, 2004

(30) Foreign Application Priority Data

Oct. 11, 2002 (JP) ..... 2002-298843

(51) Int. Cl.
*F01D 25/24* (2006.01)

(52) U.S. Cl. ..... 415/214.1; 415/208.2; 415/209.3; 415/220; 29/888.02

(58) Field of Classification Search ..... 415/211.2, 415/214.1, 208.2, 209.2, 209.3, 209.4, 220; 29/888.02, 888.021, 888.024
See application file for complete search history.

(56) References Cited

U.S. PATENT DOCUMENTS 1,849,557 A * 3/1932 Stelzer ..... 415/157
4,548,548 A * 10/1985 Gray, III ..... 415/210.1
4,872,399 A 10/1989 Chaney
5,788,566 A * 8/1998 McAnally et al. ..... 415/213.1
6,244,818 B1 6/2001 Chang
6,427,763 B1 * 8/2002 Matsumoto ..... 415/211.2
6,547,549 B1 * 4/2003 Schneider et al. ..... 425/67
6,556,437 B1 * 4/2003 Hardin ..... 415/213.1
2002/0131863 A1 9/2002 Cheng

FOREIGN PATENT DOCUMENTS

GB 2 181 183 A 4/1987
JP 10 205497 8/1998
JP 10 205497 A 8/1998

OTHER PUBLICATIONS

EP search report Application No. EP 03 25 6409 dated Nov. 25, 2004.

* cited by examiner

*Primary Examiner*—Edward K. Look
*Assistant Examiner*—Igor Kershteyn
(74) *Attorney, Agent, or Firm*—Schulte Roth & Zabel, LLP; Joel E. Lutzker; Anna Vishev

(57) ABSTRACT

A fan wherein an airflow adjustment device is used to make fine adjustments to the air discharged by the blower and a method of adjusting a fan's airflow by attaching a flow adjustment device.

24 Claims, 8 Drawing Sheets

AXIAL FLOW FAN

CROSS-REFERENCE TO RELATED APPLICATIONS

This application claims priority from Japanese Patent Application No. 2002-298843 filed on Oct. 11, 2002.

BACKGROUND OF THE INVENTION

Electronic components generate heat. In those electronic devices that house a large number of electronic components in a comparatively narrow housing, such as personal computers, LAN servers, copiers, and the like, there is a risk that heat generated by the electronic components will be accumulated inside the housing causing the internal temperature of such devices to rise to unacceptable levels and, thereby, causing the device to malfunction or causing the components within them to fail. Accordingly, ventilation holes are provided, for example, in the wall surface of the housing of such electronic devices and a blower is installed in the ventilation hole to remove heat from the housing. Additionally, blowers may be configured to cool such devices or specific components within them by blowing cool air into such devices.

The size constraints of the blowers used to remove heat from electronic devices or to cool electronic devices, as well as the airflow and discharge pressure requirements for such blowers are dependent upon the dimensions of the housing in which the blower is mounted, the quantity of heat generated inside the housing, and the density of the electrical components within the housing. Fine adjustments to a blower's output characteristics are sometimes necessary to accommodate the blower's mounting position in the housing, ambient conditions of the environment in which the device with the blower mounted thereon is disposed, or the needs of specific components in the device. For example, it is sometimes desired to incline slightly the main blowing direction with respect to the axial direction of the blower, or it is sometimes desired to adjust the airflow rate, the air pressure, the blowing sound, or the like.

The prior art includes fans, such as the fan disclosed in Japanese Patent Application Laid-open No. 10-205497, that include a plate at the fan outlet for changing the amount of the airflow and the direction of the airflow. However, such prior art fans are not capable of making all the necessary fine adjustments and they are not cost effective. Additionally, they are not easily adaptable, making it necessary to store blowers of a variety of types with slightly different specifications.

SUMMARY OF THE INVENTION

It is therefore an object of the present invention to provide a blower capable of providing all types of the above-described fine adjustment, at a low cost, in an easy and expedient manner in small-scale and low-cost fans. This object is accomplished through the use of flow adjustment devices that are easily attachable to the fan base. A variety of such flow adjustment devices can be manufactured for use with a particular model of fan, thereby, providing a low cost, expedient means of adjusting the airflow for a particular model of fan.

BRIEF DESCRIPTION OF THE DRAWINGS

The invention is illustrated by way of example and not limitation and the figures of the accompanying drawings in which like references denote like or corresponding parts, and in which.

DETAILED DESCRIPTION

Figure 1:
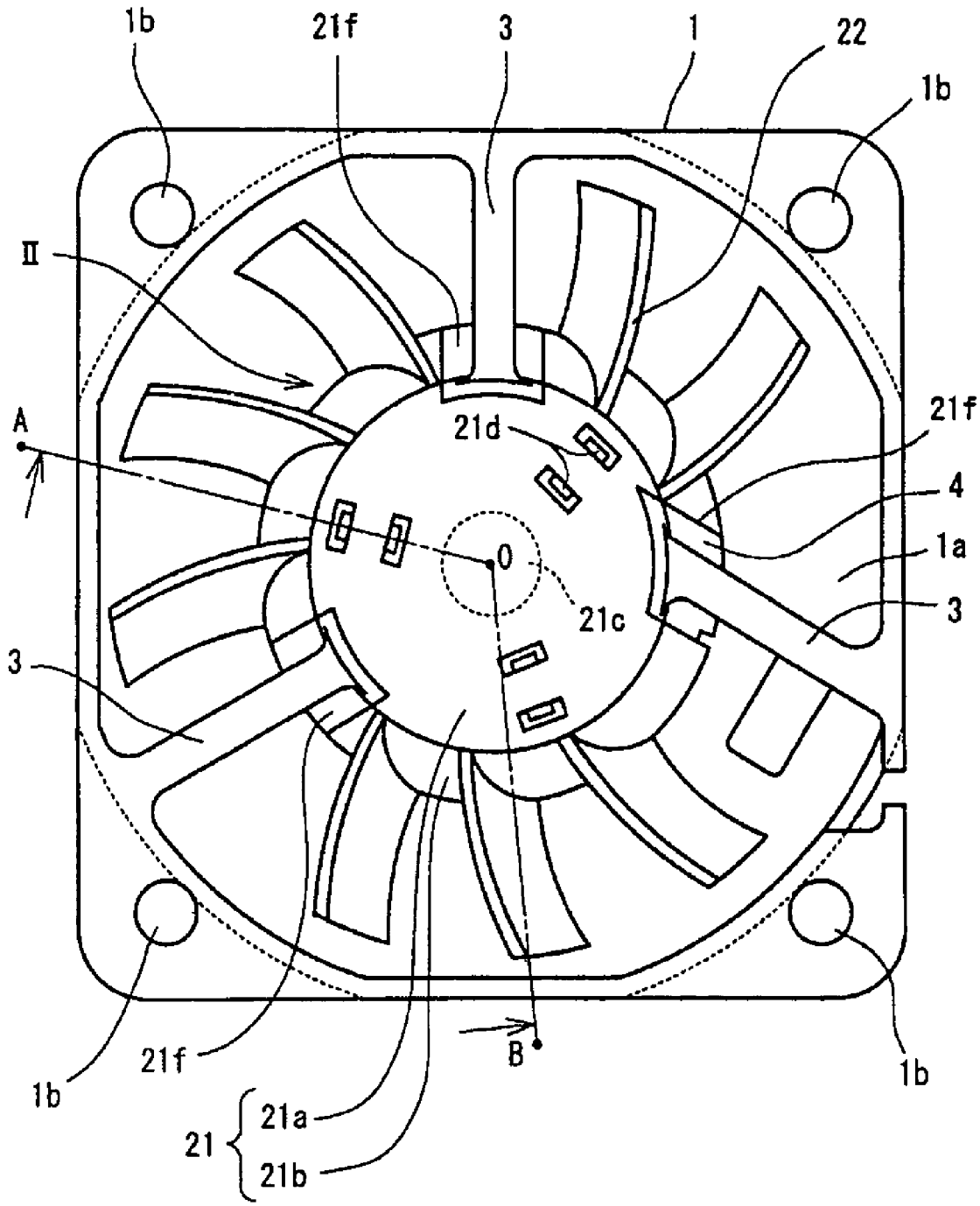
FIG. 1 illustrates a fan according to the first embodiment of the present invention, as viewed from a discharge opening side thereof.
Figure 2:
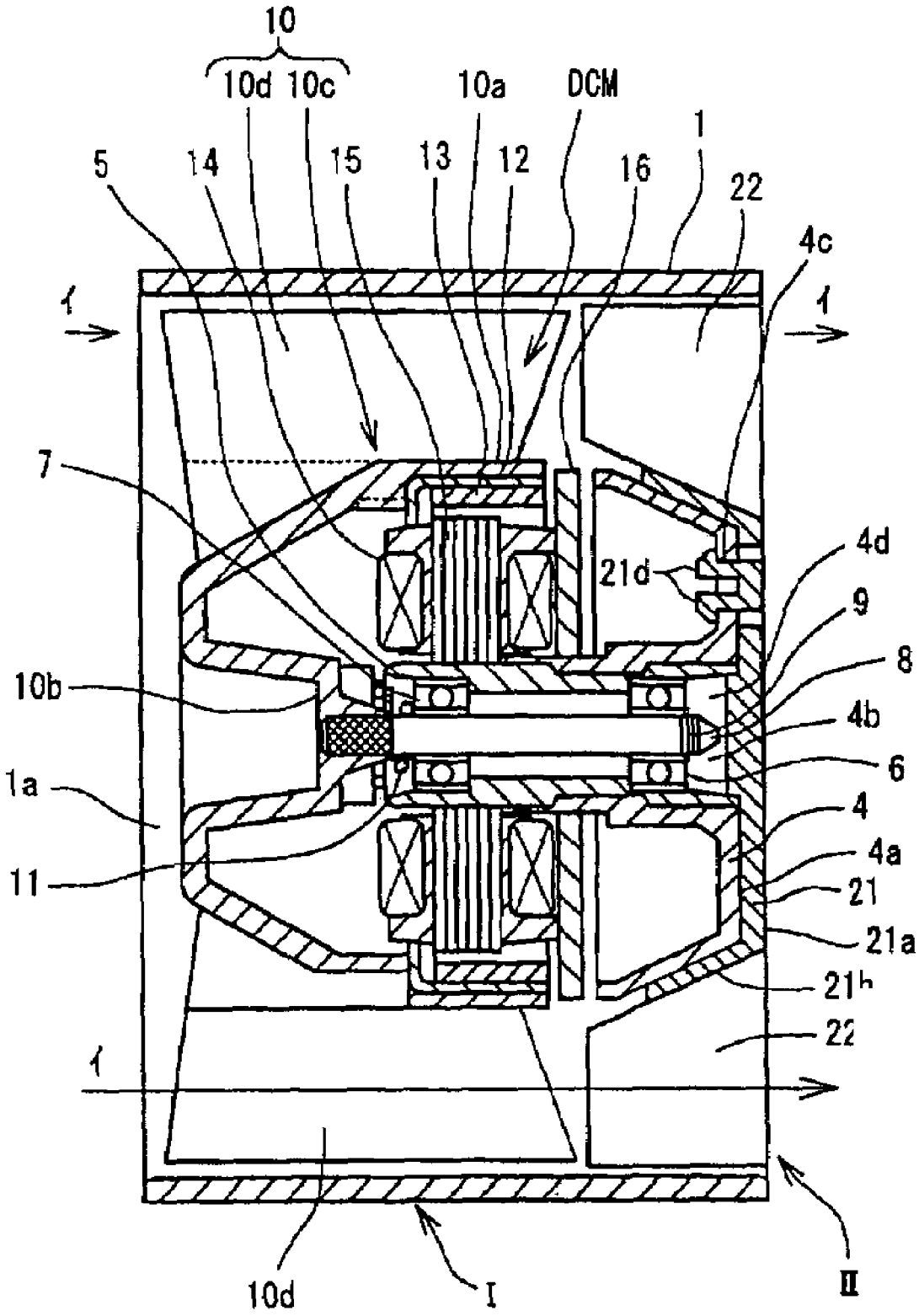
FIG. 2 shows a section of the fan shown in FIG. 1 along the line connecting points A-O-B.

FIG. 1 illustrates an embodiment of an axial fan in accordance with the present invention as viewed from the discharge opening side thereof. FIG. 2 shows a side view cross-section of the fan shown in FIG. 1 corresponding to the line connecting points A-O-B in FIG. 1 in the direction shown by the arrows, this section being open to 180°. The axial fan shown in FIGS. 1 and 2 comprises an axial flow blower I and a fixed vane II, which is one-touch attached in the below-described manner to the discharge opening side (right side in FIG. 2) of the axial flow blower I. Axial flow blower I will be described below with reference to FIGS. 1–4. Fixed vane II is a non-rotary vane for adjusting the blowing air rate, air pressure, and blowing sound (noise) in addition to adjustment of blowing direction. The fixed vane II will be described below with reference to FIGS. 5 through 8.

As shown in FIGS. 1–4, axial flow blower I is comprised of blower casing 1; round draft hole 1*a*, which is formed in the central part of blower casing 1; through holes 1*b*, which are provided in the four corner portions of the casing and which are used to mount the axial fan in an electrical device housing (not shown in the figure); ribs 3, which extend from different positions on the opening edge of draft hole 1*a* into the central portion of casing 1 on the discharge opening thereof; motor base 4, which is held in place by ribs 3; tubular bearing holder 5, which is fixedly mounted on the central portion of this motor base 4; bearings 6 and bearing 7, which are supported inside bearing holder 5 at a certain distance from each other; rotation shaft 8, which is inserted and supported bearings 6 and 7; C-shaped locking ring 9, which is installed on the distal end of rotation shaft 8 to lock rotation shaft 8 in position in the axial direction; and Impeller 10, which is connected to the rear end of rotation shaft 8 via the boss 10*b*.

As shown in FIG. 2, impeller 10 is comprised of impeller body 10*c* and a plurality of blades 10*d*. Although only two blades 10*d* are shown in FIG. 2, this embodiment includes a total five blades 10*d*, which are provided equidistantly in the rotation direction on the outer periphery of impeller body 10*c*. Additionally, for the purpose of clarity, impeller blades 10*d* are not shown in FIG. 1. Impeller body 10*c* is comprised of cylindrical part 10*a* and boss 10*b*. Impeller 10 is affixed to rotation shaft 8 by boss 10*b* such that both impeller body 10*c* and blades 10*d* are coaxial with rotation shaft 8.

As shown in FIG. 2, axial flow blower I further comprises direct current motor DCM. Motor DCM is comprised of an almost cylindrical motor yoke 12, which is fitted in and fixedly mounted on the inner periphery of cylindrical portion 10*a* of impeller 10; cylindrical permanent magnet 13, which is fixed on the inner periphery of motor yoke 12; stator winding 14; stator core 15, which is affixed to the outside of bearing holder 5; and circuit board 16. Circuit board 16 controls electric current to stator winding 14 to generate a magnetic field. The generated magnetic field interacts with permanent magnet 13 to generate a force that causes impeller 10 to rotate.

Figure 3:
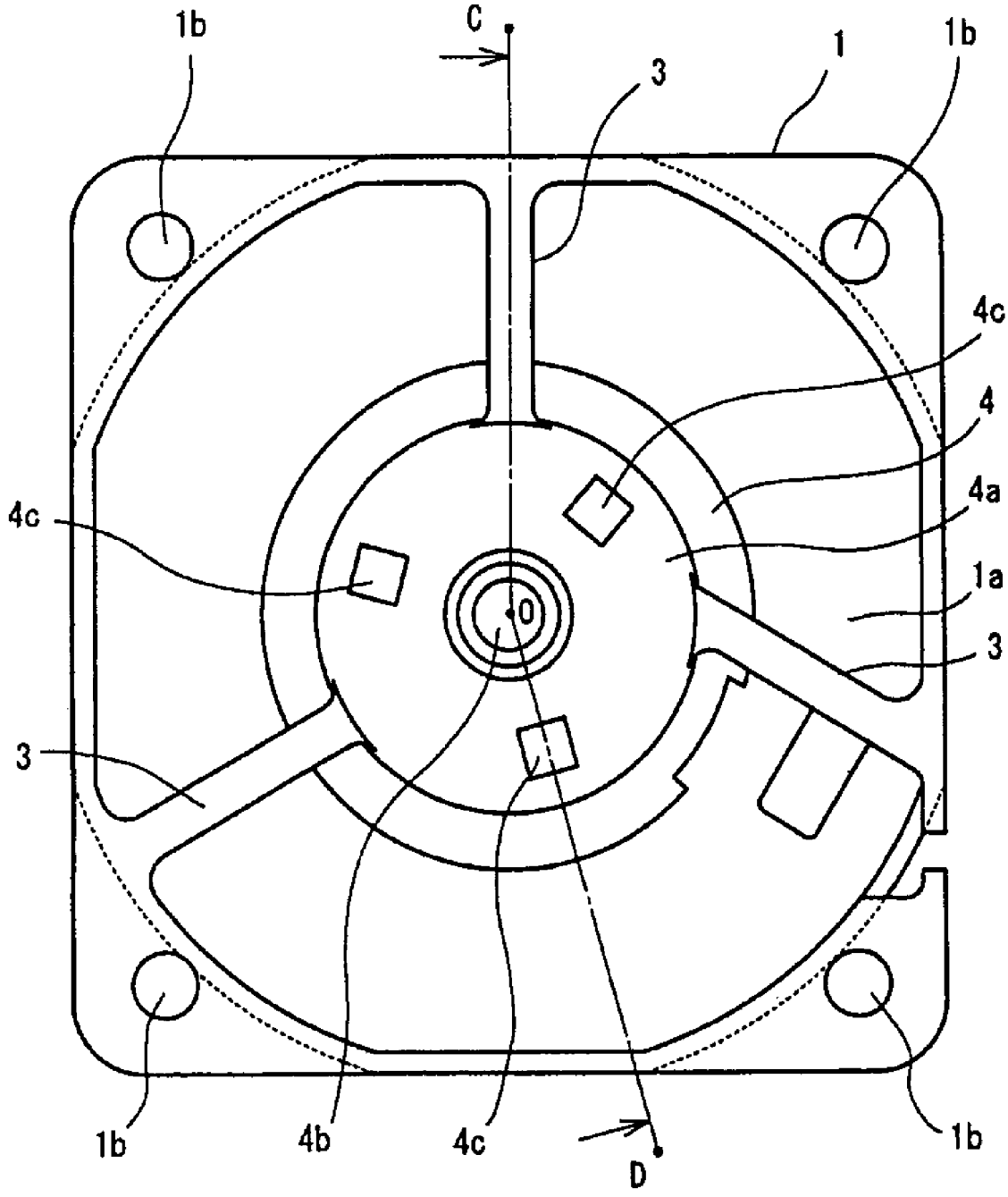
FIG. 3 shows a fan according to the first embodiment of the present invention with the casing, motor base, and bearing holder removed.
Figure 4:
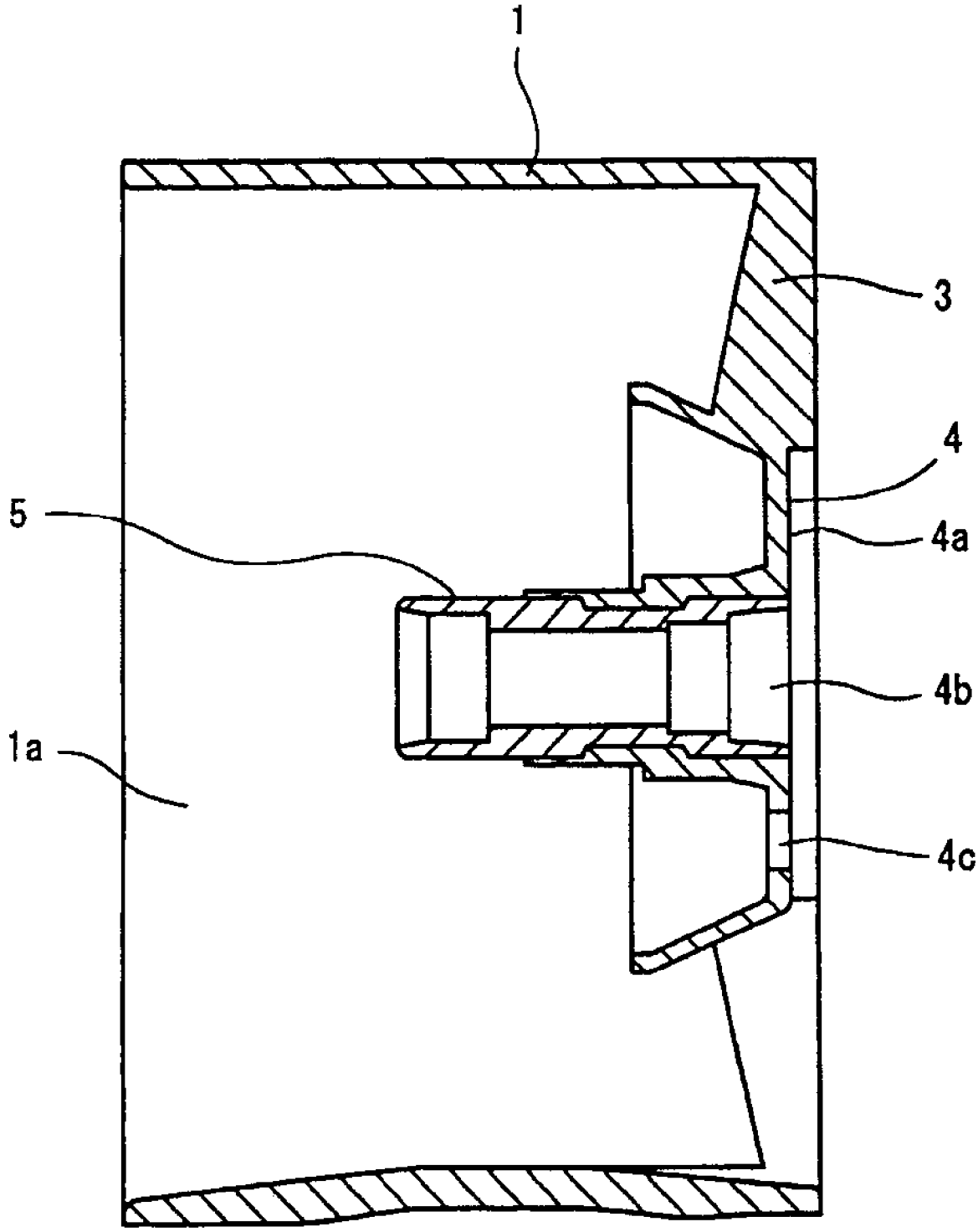
FIG. 4 shows a section of the fan shown in FIG. 3 along the line connecting points C-O-D.

Motor base plane portion 4*a* is formed on the discharge opening side (right side in FIG. 2) of motor base 4 almost as a cylinder around rotation shaft 8 and it is parallel to the plane perpendicular to the axial direction of rotation shaft 8. Through hole 4*b*, which has a diameter almost equal to the outer diameter of bearing holder 5, is provided in the center of the motor base plane portion 4*a*. As shown in FIG. 3, three small rectangular holes 4*c*, which are provided for one-touch attachment of fixed vane II, are provided equidistantly on the outer periphery of motor base plane portion 4*a*.

As shown in FIG. 2, the dimensions of rotation shaft 8 are set such that the distal end thereof (end portion on the discharge opening side of the blower) is recessed in the blower from the position of motor base plane portion 4*a* of motor base 4 and the shaft is formed so that recess 4*d* is positioned in this portion, matching the opening of through hole 4*b*. In this embodiment, casing 1, ribs 3, and motor base 4 are integrally molded from a flexible synthetic resin and the impeller 10 is integrally molded from synthetic resin of the same type. If electric power is supplied to axial flow blower I, impeller 10 rotates counterclockwise, as viewed from the left side (suction opening side) in FIG. 2 and air is blown from the left side to the right side (discharge opening side) as shown by arrow (a) in FIG. 2.

Figure 5:
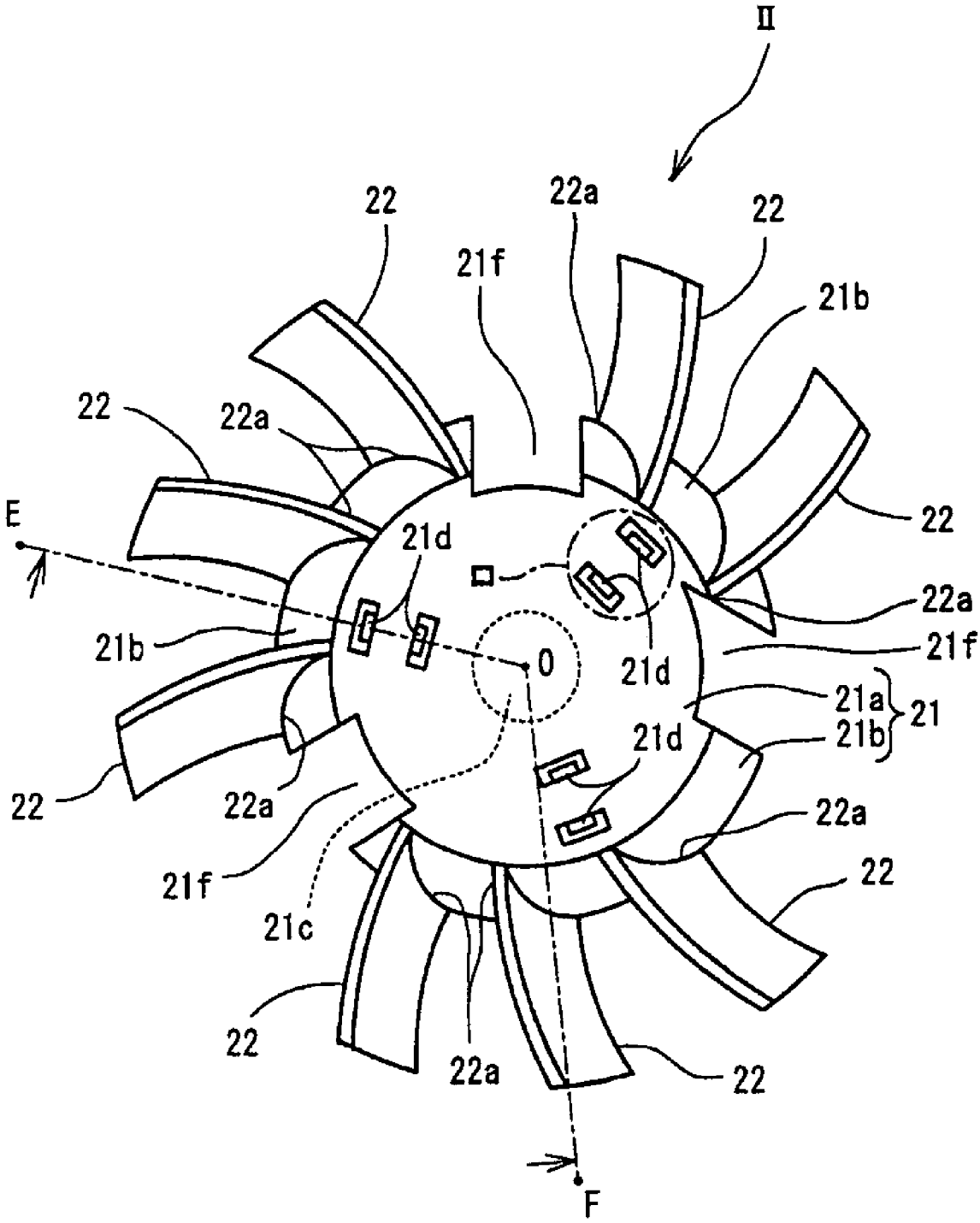
FIG. 5 shows the fixed vane portion of the first embodiment of the present invention removed from the axial flow blower portion of the first embodiment.
Figure 6:
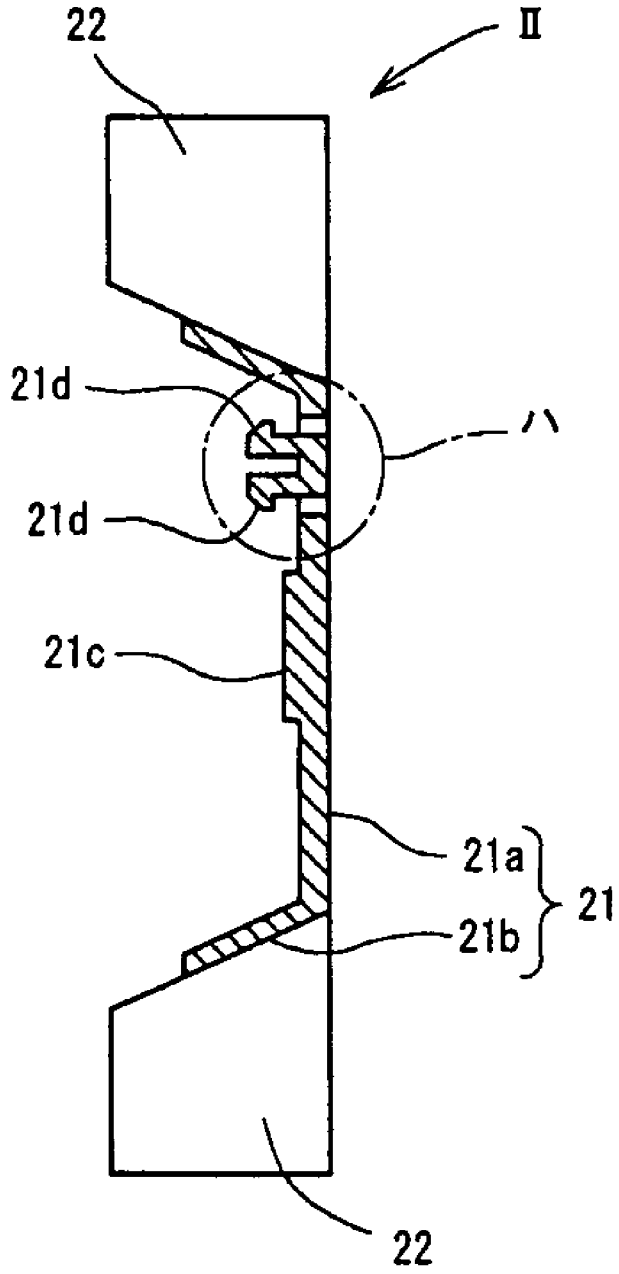
FIG. 6 shows a section of the fan shown in FIG. 5 along the line connecting points E-O-F.
Figure 7:
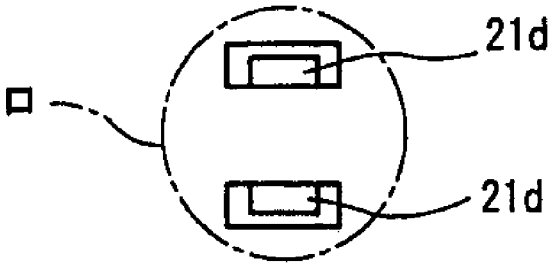
FIG. 7 is an expanded view of portion (b) shown in FIG. 5.
Figure 8:
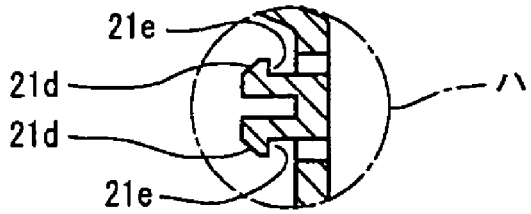
FIG. 8 is an expanded view of portion (c) shown in FIG. 6.

Fixed vane II will be described with reference to FIG. 1, and FIGS. 5 through 8. FIG. 1 shows fixed vane II attached to axial flow blower I (blades 10*d* of axial flow blower I are not shown in FIG. 1 to facilitate understanding). FIG. 5 shows fixed vane II removed from the axial flow blower I. FIG. 6 shows a section along the line connecting points E-O-F in FIG. 5 in the direction shown by the arrows, this section being open to 180°. FIG. 7 is an expanded view of portion (b) surrounded by a dash-dot line in FIG. 5, and FIG. 8 is an expanded view of portion (c) surrounded by a dash-dot line in FIG. 6.

As shown in FIG. 5 and FIG. 6, fixed vane II comprises vane base 21 and a plurality of radial vane blades 22. Vane base 21 is comprised of vane base plane portion 21*a*; turned-up wall surface 21*b*; protrusion 21*c*; three pairs of projections 21*d*, where each pair of projections 21*d* is comprised of two projections having hook-like latches 21*e*; and three notches 21*f*. Each radial vane blade 22 includes a base-end portion 22*a* for connecting the radial vane blade 22 to the turned-up wall surface 21*b* of vane base 21. Radial vane blades 22 are formed independently from each other and no parts thereof are connected, except that base-end portions 22*a* are connected to vane base 21, as shown in FIG. 5. The shape, inclination angle with respect to the blowing direction of axial flow blower I (see arrow (a) in FIG. 2), and the number of radial vane blades 22 are set appropriately according to the required adjustments in the blowing direction, airflow rate, air pressure, generated sound, and the like. The example shown in the FIGS. 5–8 includes eight slightly bent spatula-like radial vane blades 22, each being set so as to be inclined at an angle of about 30° to the blowing direction of axial flow blower I.

As shown in FIG. 2, vane base plane portion 21*a* is formed to have an almost cylindrical shape with a diameter slightly larger than that of motor base plane portion 4*a*. Turned-up wall surface 21*b*, which protrudes slightly from the circumferential edge of vane base plane portion 21*a* toward the suction opening side of axial blower 1, is formed so as to cover the side portion of motor base 4. Accordingly, the inner shape of vane base 21 is formed to match the outer shape of motor base 4. The radial vane blades 22 are connected to the turned-up wall surface 21*b* of vane base 21 and configured to minimize the dimension of fixed vane II along the axial direction of the blower.

As shown in FIGS. 5 and 6, protrusion 21*c* has a round cross section and it is formed in the central portion of vane base 21. As shown in FIG. 2, protrusion 21*c* loosely fits into recess 4*b*. During attachment, protrusion 21*c* is used for centering fixed vane II in axial flow blower I.

As shown if FIGS. 7 and 8, each pair of projections 21*d* is comprised of two projections extending from vane base plane portion 21*a* that are close to each other and that face each other. Additionally, each projection of the two projections that comprise a pair of projections 21*d* includes a hook-like latch 21*e*, where the hook-like latches 21*e* are formed on the non-facing sides of the distal end of the pairs of projections 21*d*. As shown in FIG. 2, the three pairs of projections 21*d* fit into the three small rectangular holes 4*c*, which are formed in motor base plane portion 4*a*. However, hook-like latches 21*e* extend beyond the width of rectangular holes 4*c*. Additionally, notches 21*f* are formed in positions corresponding to ribs 3 of fixed vane II in order to prevent ribs 3, which attach motor base 4 to blower casing 1, from hindering the attachment of the fixed vane II to the axial flow blower I When fixed vane II is inserted into axial flow blower I, the pairs of projections 21*d* elastically deform so as to allow the hook-like latches 21*e* to pass through rectangular holes 4*c*. After hook-like latches 21*e* pass through rectangular holes 4*c*, pairs of projections 21*d* return to their normal positions and latches 21*e* engage with the edges of small holes 4*c* thereby attaching fixed vane II to axial flow blower I.

One-touch attachment of fixed vane II to axial flow blower I is accomplished by positioning protrusion 21*c* into recess 4*b* to center fixed vane II in axial flow blower I; aligning small rectangular holes 4*c* with projections 21*d*; and applying a pushing force to fixed vane II. The applied pushing force results in a compressive force being applied by the edges of small rectangular holes 4*c* to the pairs of projections 21*d* via latches 21*e*. The compressive force elastically deforms pairs of projections 21*d* and allows latches 21*e* to pass through small rectangular holes 4*c*. Once pairs of projections 21*d* have passed through small rectangular holes 4*c*, the compressive force is removed from pairs of projections 21*d* and latches 21*e* engage with the edges of small holes 4*c* to attach fixed vane II to axial flow blower I. to 21*d* in the plane portion 4*a* and vane base plane portion 21*a* and pushing the vane base plane portion 21*a*, this pushing can be conducted in an easy and reliable manner. Thus, one-touch attachment is accomplished by positioning fixed vane II with respect to axial flow blower I and pushing them together.

The strength and rigidity of the one-touch attachment between fixed vane II and axial flow blower I can be adjusting the materials used in vane base plane portion 21*a*, pairs of projections 21*d*, or motor base plane portion 4*a* and by setting the dimensions of small rectangular holes 4*c* and pairs of projections 21*d*. Accordingly, materials and dimensions can be selected such that the one-touch attachment of fixed vane II to axial flow blower I is either detachable or non-detachable. If it is desired to make the one-touch attachment detachable, then it may be desirable to taper the bottom surface of latches 21*e*.

If the one-touch attachment is detachable, the fixed vane II can readily be replaced not only prior to product shipping, but also after shipping. Whereas, if the one-touch attachment is non-detachable, the fixed vane II will be very difficult to replace after product shipping, but it will be more reliably and strongly mounted on the axial flow blower I. In the present embodiment, an assumption is made that the desired fixed vane II is selected from a plurality of fixed vanes II of various types prior to shipping, attached to the axial flow blower I, and then shipped. In other words, a single-time attachment is assumed. Therefore, the non-detachable configuration is employed. However, either configuration or an intermediate configuration could be used.

In the above-described embodiment, the fixed vane II is formed from a flexible synthetic resin of the same type as the material of casing 1, ribs 3, and motor base 4 of axial flow blower I. As a result, the production cost can be reduced. Furthermore, projections 21*d*, which are formed in the fixed vane II, can be smoothly engaged with the small holes 4*c*, which are formed in the motor base 4.

As shown in FIG. 2, the axial dimension of fixed vane II can be set such that fixed vane II is contained within the axial dimension of flow blower I when fixed vane II is attached to flow blower I. Accordingly, an axial fan having both an axial fan blower I and a fixed vane II according to the an embodiment of the invention can have an axial width identical to an axial fan comprised of only an axial fan blower equivalent to axial fan blower I. As a result, the size of the entire apparatus can be minimized. Additionally, because the axial flow blower I is identical to standard axial flow blowers, except that small holes 4*c* have been formed therein, it can actually be used as the standard axial flow blower if the fixed vane II is not installed and the small holes 4*c* may, if necessary, be closed, for example, with tape.

Figure 9:
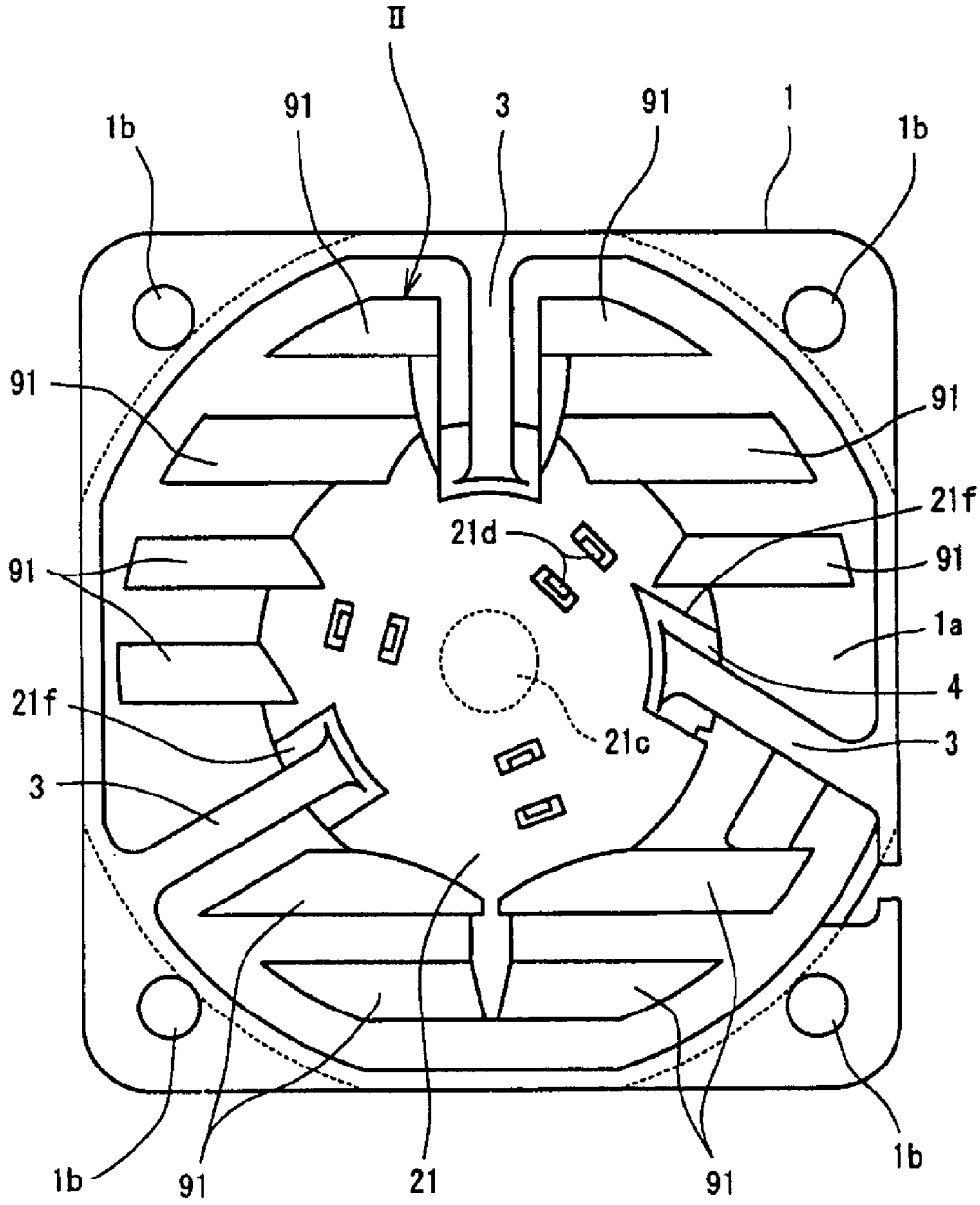
FIG. 9 illustrates the second embodiment of the present invention, as viewed from a discharge opening side thereof.
Figure 10:
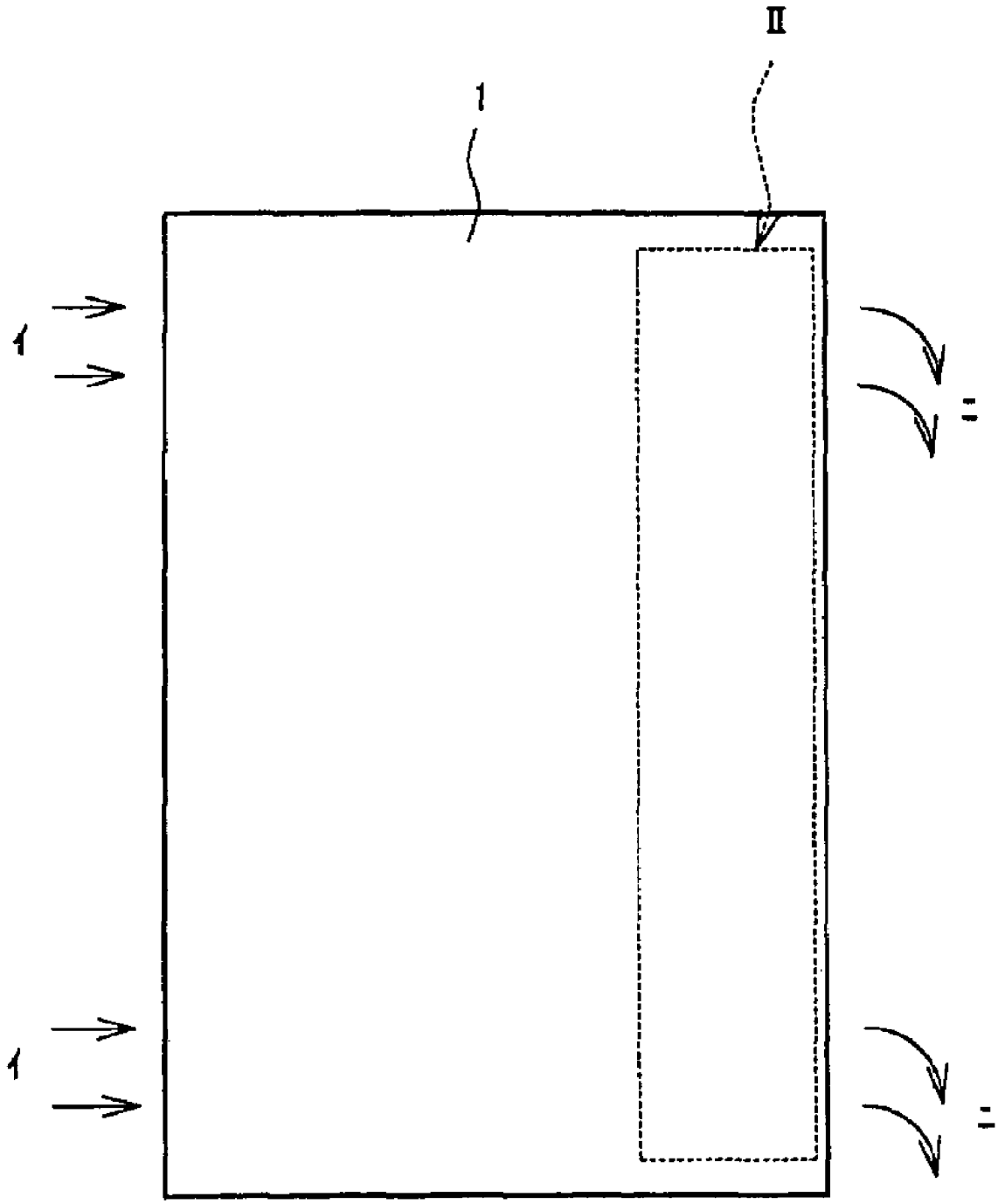
FIG. 10 illustrates the operation of the embodiment shown in FIG. 9.

A second embodiment of an axial flow fan in accordance with the present invention, as viewed from the discharge opening side, is shown in FIGS. 9 and 10. In this second embodiment, axial flow blower I is identical to the axial flow blower I used in the first embodiment and fixed vane II is in the form of a louver.

As shown in FIG. 9, fixed vane II in the second embodiment is comprised of the same components as fixed vane II in the first embodiment, except that in the second embodiment fixed vane II does not include radial vane blades 22 and instead includes straight vane blades 91 and vane base extensions 21*g*. Vane base extensions 21*g* extend from turned-up wall surface 21*b* of vane base 21. Straight vane blades 91 are attached to vane base 21 either on turned-up wall surface 21*b* or on vane base extensions 21*g*. Straight vane blades 91 are used for changing the blowing direction of the air discharged from axial flow blower I. Setting the straight vane blades 91 along the direction inclined with respect to the axial direction of the blower makes it possible to change randomly, for example, up and down or to the left and to the right, the blowing direction of the air discharged from the fan.

FIG. 10 provides an example of the second embodiment wherein fixed vane II changes the blowing direction from the axial direction (a) to a downward direction (d).

A third embodiment of the present invention is an order reception and production method whereby a plurality of types of fixed vanes suitable for finely adjusting the main blowing direction, airflow rate, air pressure, blowing sound (generated sound), and the like are prepared in advance; a fan with a desired blowing apparatus is ordered; an axial flow blowing apparatus is assembled by selecting the fixed vane suitable for the desired blowing adjustment and one-touch attaching the selected fixed vane to the discharge opening of the axial flow blower at the time of shipping, and the assembled apparatus is shipped. Accordingly, an axial flow blowing apparatus in which the desired blowing adjustment has been made can be obtained easily and rapidly without producing blowers of different types. Accordingly, such blowing apparatuses can be produced at a very low cost.

In the above-described first and second embodiments, holes were formed in the motor base and protrusions were formed on the fixed vane. However, the protrusions may be formed in the motor base and the holes may be formed in the fixed vane. In both cases, the fixed vane can be easily and expediently attached to the axial flow blower by employing one-touch attachment using a pressure insertion means comprising a hole and a protrusion. Further, attachment and detachment of the fixed vane can be conducted in an easy manner. The enumerated claims should be construed to include within their scope all such variations, as well as all other variations or modifications that may be apparent to those skilled in the art.

What is claimed is:

1. A flow adjustment device for use with a blower comprising:
- a base;
- a plurality of blades coupled to said base,
- wherein said flow adjustment device is one-touch attachable to said blower, and the blades are positioned in the form of a louver.

2. The flow adjustment device of claim 1 wherein:
- said blades are fixed; and
- positioned radially around said base.

3. A flow adjustment device for use with a blower comprising:
- a base;
- a means for mounting said flow adjustment device to said blower;
- a plurality of blades coupled to said base;
- wherein said base is comprised of:
  - a plane surface; and
  - a turned-up wall surface.

4. The flow adjustment device of claim 3 further comprising:
- a protrusion centered on the plane surface of said base.

5. The flow adjustment device of claim 3 further comprising:
- a cavity formed in the center of the plane surface of said base.

6. The flow adjustment device of claim 3 further comprising:
- a plurality of pairs of projections extending from the planar surface of said base.

7. The flow adjustment device of claim 6 wherein:
- said pairs of projections have hook-like latches.

8. The flow adjustment device of claim 3 further comprising:
- a plurality of small holes in the planar surface of said base.

9. The flow adjustment device of claim 3 further comprising:
- a plurality of notches in the turned up wall surface of said base.

10. The flow adjustment device of claim 3 further comprising:
- a protrusion centered on the plane surface of said base;
- a plurality of pairs of projections extending from the plane surface of said base; and
- a plurality of notches in the turned up wall surface of said base.

11. An axial flow blower comprising:
- a blower casing;
- a motor base having a plane surface;

a plurality of ribs for mounting said motor base to said blower casing;
a stator assembly affixed to said motor base;
a rotor assembly, including a plurality of fan blades rotatably mounted to said motor base;
a plurality of holes in said plane surface of said motor base adapted for one-touch attachment and detachment of a flow control device.

12. An axial flow blower comprising:
a blower casing;
a motor base having a plane surface;
a plurality of ribs for mounting said motor base to said blower casing;
a stator assembly affixed to said motor base;
a rotor assembly, including a plurality of fan blades, rotatably mounted to said motor base; and
a plurality of protrusions extending from said plane surface of said motor base.

13. A fan comprising:
a flow adjustment device, having:
a base;
a means for mounting said flow adjustment device to said blower;
a plurality of blades coupled to said base,
wherein said base is comprised of
a plane surface; and
a turned-up wall surface; and
a blower having a means for one touch attaching said flow adjustment device to said blower.

14. The fan of claim 13 wherein:
said flow adjustment device can be detached from said blower.

15. A fan comprising:
a blower;
a flow adjustment device;
a plurality of pairs of projections extending from said flow adjustment device; and
a plurality of openings matching each pair of projections in said blower.

16. The fan of claim 15 further comprising:
a means for centering said flow adjustment device with respect to said blower during the attachment of said flow adjustment device to said blower.

17. A fan comprising:
a blower;
a flow adjustment device;
a plurality of pairs of projections extending from said blower; and
a matching plurality of openings in said flow adjustment device.

18. A fan comprising:
a blower casing;
a motor base having a motor base plane surface;
a plurality of ribs for mounting said motor base to said blower casing;
a stator assembly affixed to said motor base;
a rotor assembly, including a plurality of fan blades, rotatably mounted to said motor base;
a plurality of holes in said motor base plane surface;
a blade base;
a plurality of blades coupled to said blade base;
wherein said blade base is comprised of:
a blade base plane surface;
a turned-up wall surface;
a protrusion centered on the blade base plane surface;
a plurality of pairs of projections extending from the blade base plane surface; and
a plurality of notches in the turned up wall surface.

19. A method of adjusting a fan's airflow comprising the step of:
one-touch attaching an airflow adjustment device to a blower, where said airflow adjustment device comprises:
a base;
a means for mounting said flow adjustment device to said blower;
a plurality of blades coupled to said base,
wherein said base is comprised of
a plane surface; and
a turned-up wall surface.

20. A method of attaching an airflow adjustment device to a blower comprising the steps of:
aligning the airflow adjustment device with the blower; and
pushing the airflow adjustment device into the blower, where said airflow adjustment device comprises:
a base;
a means for mounting said flow adjustment device to said blower;
a plurality of blades coupled to said base,
wherein said base is comprised of
a plane surface; and
a turned-up wall surface.

21. A method of manufacturing a fan comprising the steps of:
obtaining a blower of a specific type;
obtaining an airflow adjustment device, wherein said airflow adjustment device comprises:
a base;
a means for mounting said flow adjustment device to said blower;
a plurality of blades coupled to said base,
wherein said base is comprised of
a plane surface; and
a turned-up wall surface;
obtaining specific requirements for said fan; and
attaching said appropriate airflow adjustment device to said blower.

22. A method of manufacturing a fan comprising the steps of:
manufacturing a blower of a specific type;
manufacturing a plurality of types of airflow adjustment devices;
receiving an order for a fan where said order includes specific requirements for said fan;
selecting an appropriate airflow adjustment device out of said plurality of types of airflow adjustment devices according to said specific requirements;
shipping said appropriate airflow adjustment device and said blower.

23. The method of manufacturing according to claim 22 wherein:
said airflow adjustment device is attached to said blower prior to shipping.

24. A method of adjusting a fan's airflow comprising the steps of:
removing a first airflow adjustment device; and
attaching a second airflow adjustment device, wherein at least one of said first and second airflow adjustment devices comprises:
a base;
a means for mounting said flow adjustment device to said blower;
a plurality of blades coupled to said base,
wherein said base is comprised of
a plane surface; and
a turned-up wall surface.

* * * * *